US010920594B2

(12) United States Patent
Tarquinio et al.

(10) Patent No.: US 10,920,594 B2
(45) Date of Patent: Feb. 16, 2021

(54) MODAL RESPONSE TUNED TURBINE BLADE

(71) Applicant: Solar Turbines Incorporated, San Diego, CA (US)

(72) Inventors: Joshua Tarquinio, San Diego, CA (US); Loc Duong, San Diego, CA (US)

(73) Assignee: Solar Turbines Incorporated, San Diego, CA (US)

( * ) Notice: Subject to any disclaimer, the term of this patent is extended or adjusted under 35 U.S.C. 154(b) by 99 days.

(21) Appl. No.: 16/218,043

(22) Filed: Dec. 12, 2018

(65) Prior Publication Data

US 2020/0190984 A1 Jun. 18, 2020

(51) Int. Cl.
*F01D 5/14* (2006.01)

(52) U.S. Cl.
CPC ..... *F01D 5/141* (2013.01); *F05D 2220/32* (2013.01); *F05D 2250/70* (2013.01)

(58) Field of Classification Search
CPC ..... F01D 5/141; F05D 2220/32; F05D 2240/301; F05D 2240/304; F05D 2250/70
See application file for complete search history.

(56) References Cited

U.S. PATENT DOCUMENTS 4,900,230 A 2/1990 Patel
5,476,363 A 12/1995 Freling et al.
6,814,543 B2 * 11/2004 Barb ..... F01D 5/141 416/1
7,001,150 B2 2/2006 Fett et al.
7,395,799 B2 7/2008 Liang et al.
8,171,632 B2 5/2012 Kuehhorn et al.
9,121,288 B2 9/2015 Campbell et al.
9,371,733 B2 6/2016 Hartung
9,382,916 B2 7/2016 Schoenenborn
9,963,974 B2 * 5/2018 Duong ..... F01D 5/16
(Continued)

FOREIGN PATENT DOCUMENTS

EP 3379030 9/2018

*Primary Examiner* — Nathaniel E Wiehe
*Assistant Examiner* — Eric A Lange
(74) *Attorney, Agent, or Firm* — Procopio, Cory, Hargreaves & Savitch LLP

(57) ABSTRACT

A turbine blade includes a base and an airfoil. The airfoil includes a skin extending from the base and defining a leading edge and a trailing edge opposite the leading edge. The trailing edge includes an inner edge disposed proximate to the base, an outer edge disposed distal the inner edge, and a tuning region edge disposed between the inner edge and the outer edge. The tuning region edge includes an upper transition edge, a middle transition edge, a lower transition edge, an upper tuning edge, and a middle tuning edge. The upper transition edge extends from the outer edge towards the inner edge. The middle transition edge is disposed between the upper transition edge and the inner edge. The lower transition edge is disposed between the middle transition edge and the inner edge. The upper tuning edge is disposed between the upper transition edge and the middle transition edge, being at least partially closer to the leading edge than the middle transition edge. The middle tuning edge is disposed between the lower transition edge and the middle transition edge, being at least partially closer to the leading edge than the middle transition edge.

20 Claims, 5 Drawing Sheets

(56) References Cited

U.S. PATENT DOCUMENTS

| | | | | |
|---|---|---|---|---|
| 2008/0134504 | A1* | 6/2008 | Schoenenborn | F01D 5/34<br>29/889.1 |
| 2008/0145228 | A1* | 6/2008 | Truckenmueller | F01D 5/141<br>416/203 |
| 2009/0155082 | A1* | 6/2009 | Duong | F01D 5/005<br>416/223 A |
| 2014/0377075 | A1* | 12/2014 | Warikoo | F01D 5/005<br>416/223 R |
| 2018/0274558 | A1* | 9/2018 | Theratil | F04D 29/666 |

* cited by examiner

MODAL RESPONSE TUNED TURBINE BLADE

TECHNICAL FIELD

The present disclosure generally pertains to gas turbine engines. More particularly this application is directed toward a modal response tuned turbine blade.

BACKGROUND

Internally cooled turbine blades may include passages within the blade. These hollow blades may be cast. In casting hollow gas turbine engine blades having internal cooling passageways, a fired ceramic core is positioned in a ceramic investment shell mold to form internal cooling passageways in the cast airfoil. The fired ceramic core used in investment casting of hollow airfoils typically has an airfoil-shaped region with a thin cross-section leading edge region and trailing edge region. Between the leading and trailing edge regions, the core may include elongated and other shaped openings so as to form multiple internal walls, pedestals, turbulators, ribs, and similar features separating and/or residing in cooling passageways in the cast airfoil. Cooled and un-cooled blades share the same characteristics of thinner trailing edge in comparison to leading edge, which makes it more susceptible to modal responses.

U.S. patent publication No. 2009/0155082 to Loc Duong, describes an airfoil for a gas turbine engine component such as a turbine blade is tuned to move its natural frequency outside of a frequency which will be excited during expected speed range of an associated gas turbine engine. The airfoil is tuned about locations of the anti-nodes in an original airfoil design. The tuning affects only the interfered frequency.

The present disclosure is directed toward overcoming one or more of the problems discovered by the inventors.

SUMMARY

A turbine blade for a gas turbine engine is disclosed herein. In embodiments the turbine blade includes a base and an airfoil. The airfoil includes a skin extending from the base and defining a leading edge and a trailing edge opposite the leading edge. The trailing edge includes an inner edge disposed proximate to the base, an outer edge disposed distal the inner edge, and a tuning region edge disposed between the inner edge and the outer edge.

The tuning region edge includes an upper transition edge, a middle transition edge, a lower transition edge, an upper tuning edge, and a middle tuning edge. The upper transition edge extends from the outer edge towards the inner edge. The middle transition edge is disposed between the upper transition edge and the inner edge. The lower transition edge is disposed between the middle transition edge and the inner edge. The upper tuning edge is disposed between the upper transition edge and the middle transition edge, being at least partially closer to the leading edge than the middle transition edge. The middle tuning edge is disposed between the lower transition edge and the middle transition edge, being at least partially closer to the leading edge than the middle transition edge.

BRIEF DESCRIPTION OF THE FIGURES

The details of embodiments of the present disclosure, both as to their structure and operation, may be gleaned in part by study of the accompanying drawings, in which like reference numerals refer to like parts, and in which.

DETAILED DESCRIPTION

The detailed description set forth below, in connection with the accompanying drawings, is intended as a description of various embodiments and is not intended to represent the only embodiments in which the disclosure may be practiced. The detailed description includes specific details for the purpose of providing a thorough understanding of the embodiments. However, it will be apparent to those skilled in the art that the disclosure without these specific details. In some instances, well-known structures and components are shown in simplified form for brevity of description.

Figure 1:
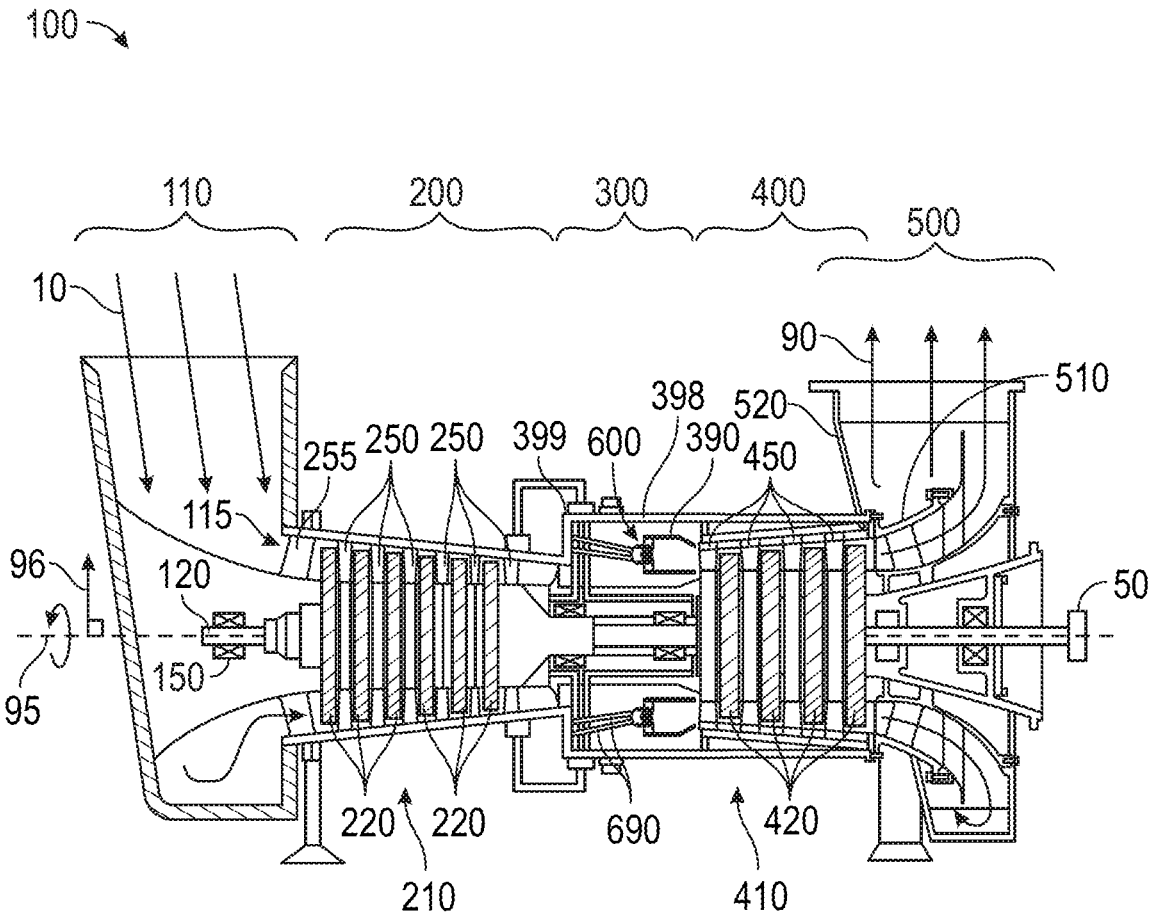
FIG. 1 is a schematic illustration of an exemplary gas turbine engine.

FIG. 1 is a schematic illustration of an exemplary gas turbine engine. Some of the surfaces have been left out or exaggerated for clarity and ease of explanation. Also, the disclosure may reference a forward and an aft direction. Generally, all references to "forward" and "aft" are associated with the flow direction of primary air (i.e., air used in the combustion process), unless specified otherwise. For example, forward is "upstream" relative to primary air flow, and aft is "downstream" relative to primary air flow.

In addition, the disclosure may generally reference a center axis 95 of rotation of the gas turbine engine, which may be generally defined by the longitudinal axis of its shaft 120 (supported by a plurality of bearing assemblies 150). The center axis 95 may be common to or shared with various other engine concentric components. All references to radial, axial, and circumferential directions and measures refer to center axis 95, unless specified otherwise, and terms such as "inner" and "outer" generally indicate a lesser or greater radial distance from, wherein a radial 96 may be in any direction perpendicular and radiating outward from center axis 95.

A gas turbine engine 100 includes an inlet 110, a gas producer or compressor 200, a combustor 300, a turbine 400, an exhaust 500, and a power output coupling 50. The compressor 200 includes one or more compressor rotor assemblies 220. The combustor 300 includes one or more injectors 600 and includes one or more combustion chambers 390. The turbine 400 includes one or more turbine rotor assemblies 420. The exhaust 500 includes an exhaust diffuser 510 and an exhaust collector 520.

As illustrated, both compressor rotor assembly 220 and turbine rotor assembly 420 are axial flow rotor assemblies, where each rotor assembly includes a rotor disk that is circumferentially populated with a plurality of airfoils ("rotor blades"). When installed, the rotor blades associated with one rotor disk are axially separated from the rotor blades associated with an adjacent disk by stationary vanes ("stator vanes" or "stators") circumferentially distributed in an annular casing.

A gas (typically air 10) enters the inlet 110 as a "working fluid", and is compressed by the compressor 200. In the compressor 200, the working fluid is compressed in an annular flow path 115 by the series of compressor rotor assemblies 220. In particular, the air 10 is compressed in numbered "stages", the stages being associated with each compressor rotor assembly 220. For example, "4th stage air" may be associated with the 4th compressor rotor assembly 220 in the downstream or "aft" direction—going from the inlet 110 towards the exhaust 500). Likewise, each turbine rotor assembly 420 may be associated with a numbered stage. For example, first stage turbine rotor assembly 421 is the forward most of the turbine rotor assemblies 420. However, other numbering/naming conventions may also be used.

Once compressed air 10 leaves the compressor 200, it enters the combustor 300, where it is diffused and fuel 20 is added. Air 10 and fuel 20 are injected into the combustion chamber 390 via injector 600 and ignited. After the combustion reaction, energy is then extracted from the combusted fuel/air mixture via the turbine 400 by each stage of the series of turbine rotor assemblies 420. Exhaust gas 90 may then be diffused in exhaust diffuser 510 and collected, redirected, and exit the system via an exhaust collector 520. Exhaust gas 90 may also be further processed (e.g., to reduce harmful emissions, and/or to recover heat from the exhaust gas 90).

One or more of the above components (or their subcomponents) may be made from stainless steel and/or durable, high temperature materials known as "superalloys". A superalloy, or high-performance alloy, is an alloy that exhibits excellent mechanical strength and creep resistance at high temperatures, good surface stability, and corrosion and oxidation resistance. Superalloys may include materials such as HASTELLOY, INCONEL, WASPALOY, RENE alloys, HAYNES alloys, INCOLOY, MP98T, TMS alloys, and CMSX single crystal alloys.

Figure 2:
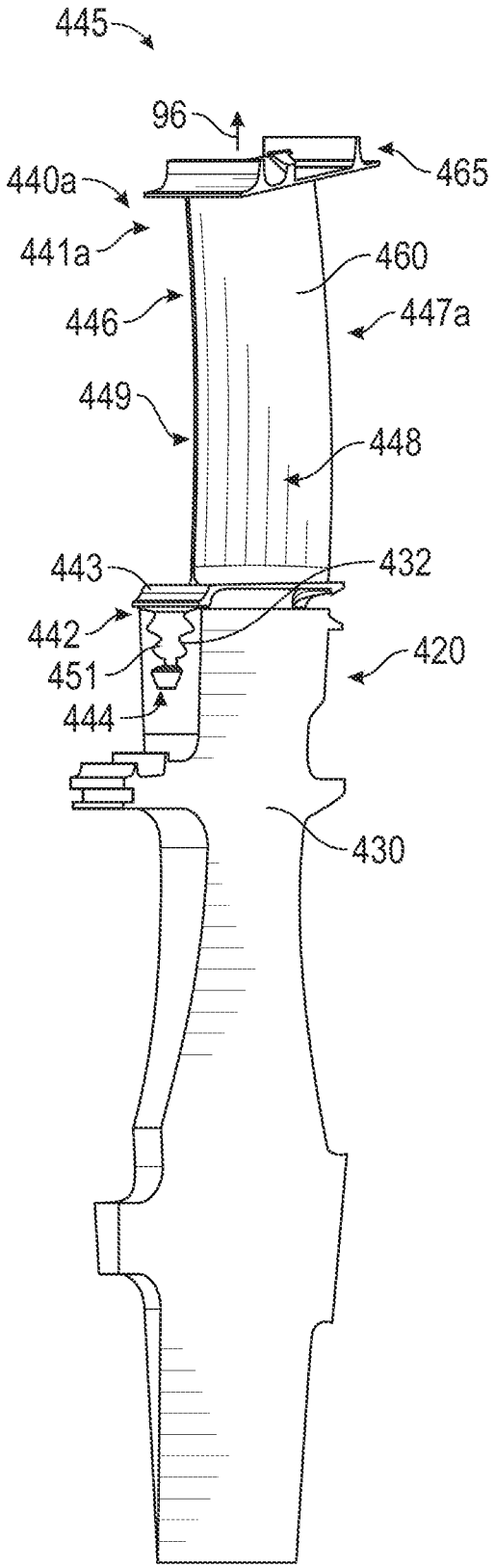
FIG. 2 is a cross sectional view of a portion of an exemplary turbine rotor assembly.

FIG. 2 is an cross sectional view of a portion of an exemplary turbine rotor assembly. In particular, a portion of the turbine rotor assembly 420 schematically illustrated in FIG. 1 is shown here in greater detail, but in isolation from the rest of gas turbine engine 100 and the rest of the turbine rotor assembly. The portion of the turbine rotor assembly 420 shown in FIG. 2 includes a portion of a turbine rotor disk 430 cross sectioned on both sides corresponding approximately to the area under a turbine blade 440*a*. The turbine blade 440*a* may include a base 442 including a platform 443 and a blade root 451. For example, the blade root 451 may incorporate "fir tree", "bulb", or "dove tail" roots, to list a few. Correspondingly, the turbine rotor disk 430 may include a circumferentially distributed slot or blade attachment groove 432 configured to receive and retain the turbine blade 440*a*. In particular, the blade attachment groove 432 may be configured to mate with the blade root 451, both having a reciprocal shape with each other. In addition the blade root 451 may be slideably engaged with the blade attachment groove 432, for example, in a forward-to-aft direction.

The turbine blade 440*a* may further include an airfoil 441*a* extending radially outward from the platform 443. The airfoil 441*a* may have a complex, geometry that varies radially. For example the cross section of the airfoil 441*a* may lengthen, thicken, twist, and/or change shape as it radially approaches the platform 443 inward from a tip end 445. The overall shape of airfoil 441*a* may also vary from application to application.

The turbine blade 440*a* is generally described herein with reference to its installation and operation. In particular, the turbine blade 440*a* is described with reference to both a radial 96 of center axis 95 (FIG. 1) and the aerodynamic features of the airfoil 441*a*. The aerodynamic features of the airfoil 441*a* include a leading edge 446, a trailing edge 447*a*, a pressure side 448, and a lift side 449. As discussed above, airfoil 441*a* also extends radially between the platform 443 and the tip end 445. The turbine blade may include a shrouding 465. The shrouding 465 may be located outward from the airfoil 441*a* and is disposed opposite from the root end 444. The shrouding 465 may be formed as part of each turbine blade 440*a* and may interface with the airfoil 441*a* at the tip end 445. Thus, when describing the turbine blade 440*a* as a unit, the inward direction is generally radially inward toward the center axis 95 (FIG. 1), with its associated end called a "root end" 444. Likewise the outward direction is generally radially outward from the center axis 95 (FIG. 1), with its associated end being defined by the tip end 445 or in some embodiments the shrouding 465.

In addition, when describing the airfoil 441*a*, the forward and aft directions are generally measured between its leading edge 446 (forward) and its trailing edge 447*a* (aft) When describing the flow features of the airfoil 441*a*, the inward and outward directions are generally measured in the radial direction relative to the center axis 95 (FIG. 1).

Finally, certain traditional aerodynamics terms may be used from time to time herein for clarity, but without being limiting. For example, while it will be discussed that the airfoil 441*a* (along with the entire turbine blade 440*a*) may be made as a single metal casting, the outer surface of the airfoil 441*a* (along with its thickness) is descriptively called herein the "skin" 460 of the airfoil 441*a*.

Figure 3:
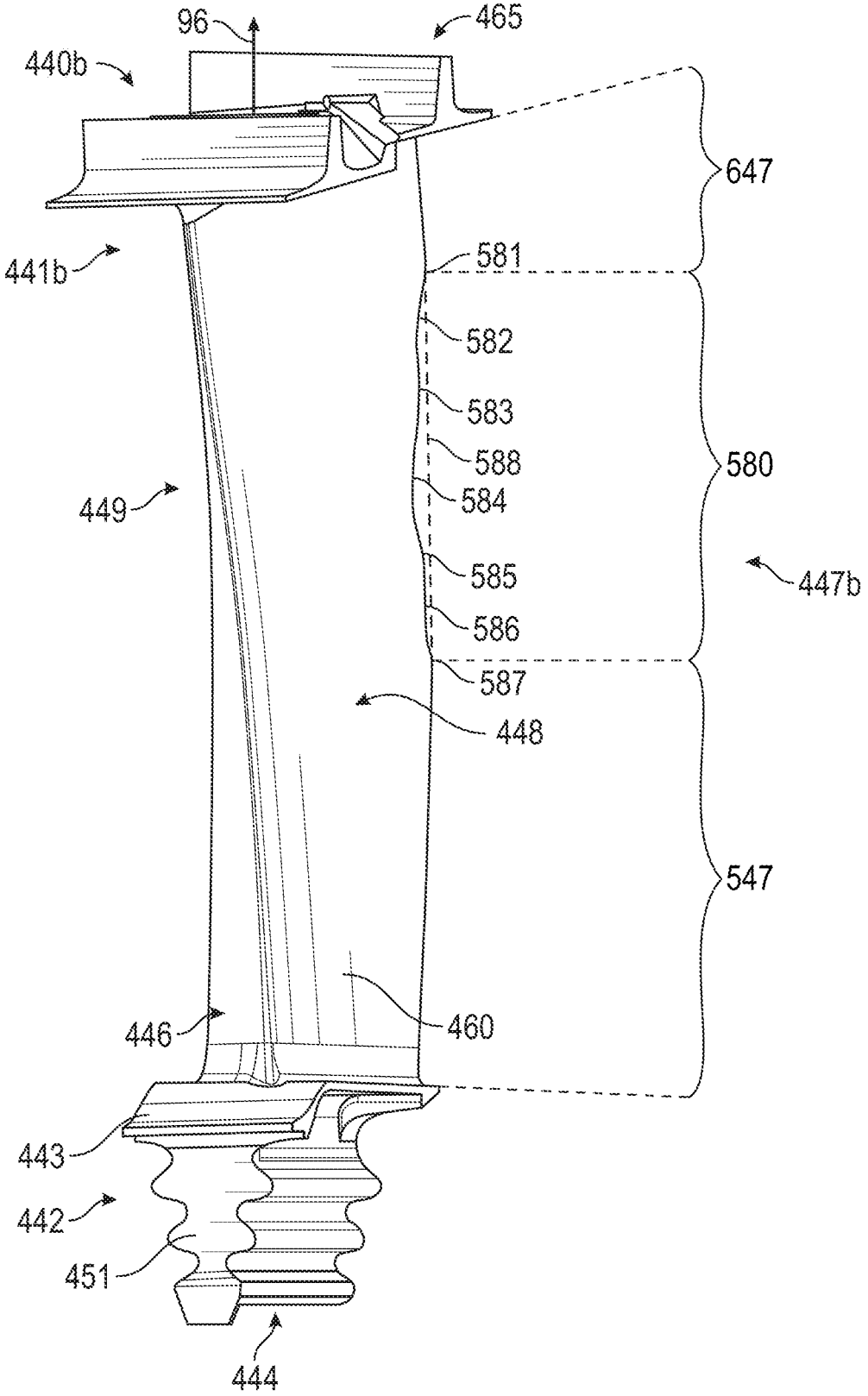
FIG. 3 is a perspective view of another embodiment of a turbine blade.

FIG. 3 is a perspective view of another embodiment of a turbine blade. Structures and features previously described in connection with earlier described embodiments may not be repeated here with the understanding that when appropriate, that previous description applies to the embodiment depicted in FIG. 3, as well as FIG. 4 and FIG. 5. Additionally, the emphasis in the following description is on variations of previously introduced features or elements. Also, some reference numbers for previously descripted features are omitted.

The turbine blade 440*b* includes an airfoil 441*b*, the base 442, and may include the shrouding 465. The base 442 may include the platform 443, the blade root 451, and the root end 444. The airfoil 441*b* interfaces with the base 442 and can interface with the shrouding 465 at the tip end 445 and may include a trailing edge 447*b*. The trailing edge 447*b* may include an inner edge 547, a tuning region edge 580, and an outer edge 647. The inner edge 547 can be disposed proximate the base 442. In other words the inner edge 547 may extend from the base 442 towards the tip end 445. The outer edge 647 can be disposed distal the inner edge 547. In other words the outer edge 647 can be proximate the tip end 445. In other words the outer edge 647 can extend from the tip end 445 towards the base 442. The tuning region edge 580 is disposed between the inner edge 547 and the outer edge. In other words the tuning region edge 580 is disposed outward from the inner edge 547 and inward of the outer edge 647.

Shown with the tuning region edge 580 is a dashed line representing a tuning region reference line 588 that is linear from the outward extent of the tuning region edge 580 to the inward extent of the tuning region edge 580. In other words the tuning region reference line 588 extends from the outward extent of the inner edge 547 to the inward extend of the outer edge 647. In another embodiment, the tuning region reference line 588 may extend from the inner edge 547 towards the outer edge 647 and continue a contour of the inner edge 547 and may extend from the outer edge 647 towards the inner edge 547 and continue a contour of the outer edge 647, while maintaining a convex curvature between the inner edge 547 and the outer edge 647.

The tuning region edge 580 may include an upper transition edge 581, a middle transition edge 583, a lower transition edge 585, an upper tuning edge 582, a middle tuning edge 584, a bottom transition edge 587, and a lower tuning edge 586.

The upper transition edge 581 may extend from the outer edge 647 towards the inner edge 547. The upper transition edge 581 may be disposed between the outer edge 647 and the upper tuning edge 582. The upper transition edge 581 may extend from the outer edge 647 to the upper tuning edge 582. The upper transition edge 581 may transition the curvature between the outer edge 647 and the upper tuning edge 582. The upper transition edge 581 may be formed during the casting and manufacturing process of the turbine blade 440*b* or by removing material from an existing turbine blade. The upper transition edge 581 may have a convex shape.

The middle transition edge 583 may be disposed between the upper tuning edge 582 and the middle tuning edge 584. The middle transition edge 583 may be disposed between the upper transition edge 581 and the inner edge 547. The middle transition edge 583 may extend from the upper tuning edge to the middle tuning edge 584. The middle transition edge 583 may transition the curvature between the upper tuning edge 582 and the middle tuning edge 584. In other words, the middle transition edge 583 may smooth the transition between the upper tuning edge 582 and the middle tuning edge 584. The middle transition edge 583 may be formed during the casting and manufacturing process of the turbine blade 440*b* or by removing material from an existing turbine blade. The middle transition edge 583 may have a convex shape.

The lower transition edge 585 may be disposed between the inner edge 547 and the middle tuning edge 584. The lower transition edge 585 may be disposed between the lower tuning edge 586 and the middle tuning edge 584. The lower transition edge 585 may extend from the middle tuning edge 584 to the lower tuning edge 586. The lower transition edge 585 may transition the curvature between a lower tuning edge 586 and the middle tuning edge 584. In other words, the lower transition edge 585 may smooth the transition between the lower tuning edge 586 and the middle tuning edge 584. The lower transition edge 585 may be formed during the casting and manufacturing process of the turbine blade 440*b* or by removing material from an existing turbine blade. The middle transition edge 583 may have a convex shape.

The upper tuning edge 582 may be disposed between the upper transition edge 581 and the middle transition edge 583. The upper tuning edge 582 can extend from the upper transition edge 581 to the middle transition edge 583. The upper tuning edge 582 may be a volume removed from the trailing edge of an existing turbine blade shaped similar to the turbine blade 440*a* to create the turbine blade 440*b*. The upper tuning edge 582 can have a constant radius. In another embodiment, the upper tuning edge 582 may have a variable radius. In another embodiment the upper tuning edge 582 can have a "V" notch. In an embodiment the upper tuning edge 582 has an elliptical shape. In another embodiment the upper tuning edge 582 has a shape that is flat or straight. The upper tuning edge 582 can be at least partially closer to the leading edge 446 than the middle transition edge 583. The upper tuning edge 582 can be at least partially closer to the leading edge 446 than the upper transition edge 581, the lower transition edge 585, and a bottom transition edge 587. The upper tuning edge 582 can be at least partially further from the tuning region reference line 588 than the middle transition edge 583. The upper tuning edge 582 can be at least partially further from the tuning region reference line 588 than the upper transition edge 581, the lower transition edge 585, and the bottom transition edge 587. The upper tuning edge 582 can have a concave shape.

The middle tuning edge 584 can be disposed between the lower transition edge 585 and the middle transition edge 583. In other words, the middle tuning edge 584 can extend from the middle transition edge 583 to the lower transition edge 585. The middle tuning edge 584 may be a volume removed from the trailing edge of an existing turbine blade shaped similar to the turbine blade 440*a* to create the turbine blade 440*b*. The middle tuning edge 584 can have a constant radius. In another embodiment the middle tuning edge 584 can have a variable radius. In another embodiment the middle tuning edge 584 is shaped like a "V" notch. In an embodiment the middle tuning edge 584 has an elliptical shape. In another embodiment the middle tuning edge 584 has a shape that is mostly flat or straight. The middle tuning edge 584 can be at least partially closer to the leading edge 446 than the middle transition edge 583. The middle tuning edge 584 can be at least partially closer to the leading edge 446 than the upper transition edge 581, the lower transition edge 585, and the bottom transition edge 587. The middle tuning edge 584 can be at least partially further from the tuning region reference line 588 than the middle transition edge 583. The middle tuning edge 584 can be at least partially further from the tuning region reference line 588 than the upper transition edge 581, the lower transition edge 585, and the bottom transition edge 587. The middle tuning edge 584 may have a concave shape.

The bottom transition edge 587 may be disposed between the lower tuning edge 586 and the inner edge 547. The bottom transition edge 587 can extend from the lower tuning edge 586 to the inner edge 547. The bottom transition edge 587 may transition the curvature between a lower tuning edge 586 and the inner edge 547. In other words, the bottom transition edge 587 may smooth the transition between the lower tuning edge 586 and the inner edge 547. The bottom transition edge 587 may be formed during the casting and manufacturing process of the turbine blade 440*b* or by removing material from an existing turbine blade. The bottom transition edge 587 may have a convex shape.

The lower tuning edge 586 can be disposed between the lower transition edge 585 and the bottom transition edge 587. The lower tuning edge 586 may be a volume removed from the turbine blade 440*a* to retrofit into the turbine blade 440*b*. The lower tuning edge 586 can have a constant radius. In another embodiment the lower tuning edge 586 can have a variable radius. In another embodiment the lower tuning edge 586 can have a "V" notch. In an embodiment the lower tuning edge 586 has an elliptical shape. In another embodiment the lower tuning edge 586 has a shape that is mostly flat or straight. The lower tuning edge 586 may have a concave shape. The lower tuning edge 586 can be at least partially closer to the leading edge 446 than the bottom transition edge 587. The lower tuning edge 586 can be at least partially closer to the leading edge 446 than the inner edge 547. The lower tuning edge 586 can be at least partially further from the tuning region reference line 588 than the bottom transition edge 587. The middle tuning edge 584 can be at least partially further from the tuning region reference line 588 than the inner edge 547.

Figure 4:
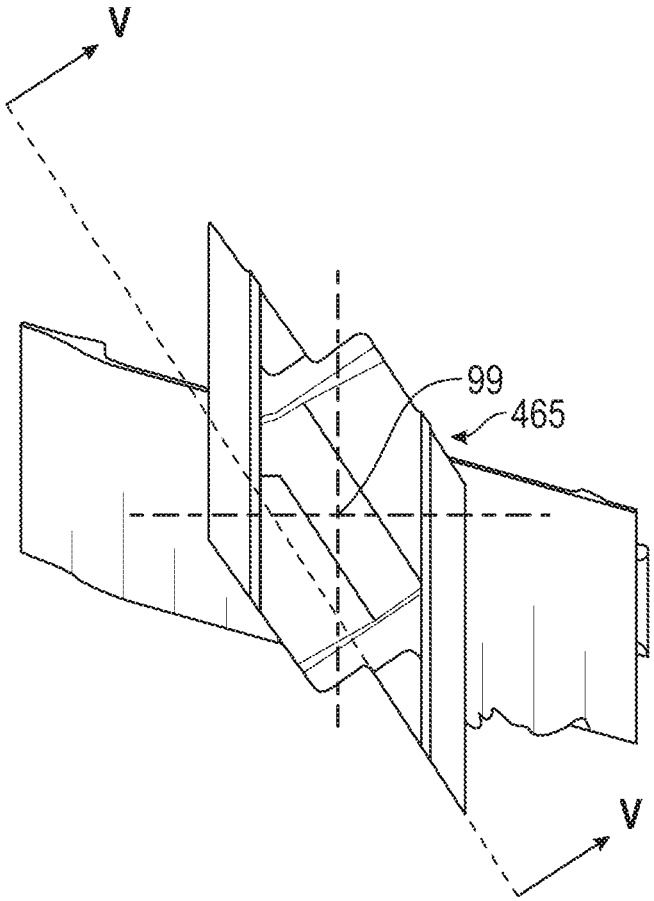
FIG. 4 is a plan view of the turbine blade of FIG. 3.

FIG. 4 is a plan view of the turbine blade of FIG. 3. In an embodiment. The turbine blade 440*b* has a stacking axis 99.

The stacking axis 99 is a linear axis that passes through the airfoil 441*b* and the base 442 centroids and radially extends from the center axis 95. In an embodiment, the stacking axis 99 is a linear axis that also passes through the shrouding 465 centroid.

Figure 5:
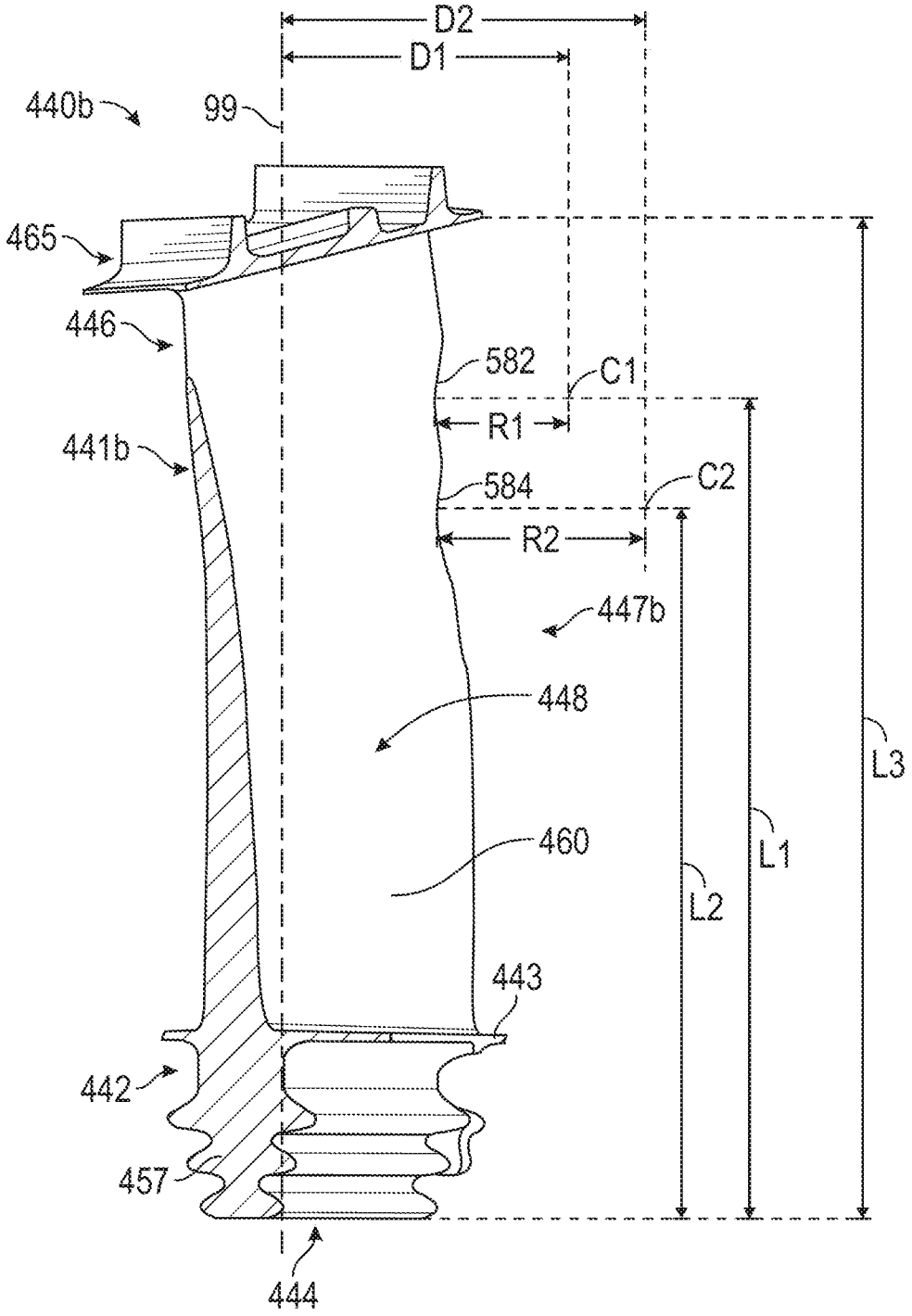
FIG. 5 is a cross sectional view of the turbine blade of FIG. 4 along line V-V

FIG. 5 is a cross section of the turbine blade taken along the line V-V of FIG. 4. In an embodiment, the upper tuning edge 582 may have a first radius R1 for a circle with a first center point of C1. The first center point C1 may be spaced from the stacking axis 99 at a first distance D1. The first center point C1 may be spaced from the root end 444 at a first length of L1.

In an embodiment the middle tuning edge 584 may have a second radius R2 for a circle with a second center point of C2. The second center point C2 may be spaced from the stacking axis 99 at a second distance D2. The second center point C2 may be spaced from the root end 444 at a second length of L2. In an embodiment, the distance from the tip end 445 to the root end 444 can be a third length L3.

The trailing edge 447*b* may have a ratio of a first length L1 to a third length L3 ranging from 0.65 to 0.90. The trailing edge 447*b* may have a ratio of a second length L2 to a first length L1 ranging from 0.55 to 0.88. The trailing edge 447*b* may have a ratio of a first radius R1 to a second radius R2 ranging from 0.50 to 1.50. The trailing edge 447*b* may have a ratio of a second distance D2 to a first distance D1 ranging from 0.8 to 1.60.

INDUSTRIAL APPLICABILITY

The present disclosure generally applies to turbine blades 440*a*, 440*b*, and gas turbine engines 100 having turbine blades 440*a*, 440*b*. The described embodiments are not limited to use in conjunction with a particular type of gas turbine engine 100, but rather may be applied to stationary or motive gas turbine engines, or any variant thereof. Gas turbine engines, and thus their components, may be suited for any number of industrial applications, such as, but not limited to, various aspects of the oil and natural gas industry (including include transmission, gathering, storage, withdrawal, and lifting of oil and natural gas), power generation industry, cogeneration, aerospace and transportation industry, to name a few examples.

Generally, embodiments of the presently disclosed turbine blades 440*a*, 440*b* are applicable to the use, assembly, manufacture, operation, maintenance, repair, and improvement of gas turbine engines 100, and may be used in order to improve performance and efficiency, decrease maintenance and repair, and/or lower costs. In addition, embodiments of the presently disclosed turbine blades 440*a*, 440*b* may be applicable at any stage of the gas turbine engine's 100 life, from design to prototyping and first manufacture, and onward to end of life. Accordingly, the turbine blades 440*a*, 440*b* may be used in a first product, as a retrofit or enhancement to existing gas turbine engine, as a preventative measure, or even in response to an event. This is particularly true as the presently disclosed turbine blades 440*a*, 440*b* may conveniently include identical interfaces to be interchangeable with an earlier type of turbine blades.

As discussed above, the entire turbine blade 440*a*, 440*b* may be cast formed. According to one embodiment, the turbine blade 440*a*, 440*b* may be made from an investment casting process. For example, the entire turbine blade 440*a*, 440*b* may be cast from stainless steel and/or a superalloy using a ceramic core or fugitive pattern. In another embodiment, the turbine blade 440*a* may be shaped into turbine blade 440*b* after the casting process. Notably, while the structures/features have been described above as discrete members for clarity, as a single casting, the structures/features may be integrated with the skin 460. Alternately, certain structures/features may be added to a cast core, forming a composite structure.

In the disclosed embodiment, the turbine blade 440*a*, 440*b* has several natural frequencies and modal responses that are generally static (dormant/un-excited) as the speed of the associated gas turbine engine 100 increases. These modal responses include a first torsional modal response, a first flexural modal response, and a first bending response, which can be the strongest of the modal responses. Turbine blades 440*a*, 440*b* can also have second, third, and further consecutive modal responses, however these are typically not strong enough to be considered to be mitigated for. If the first modal responses occur within the operating speed (typically reported in rotations per minute, RPM) range of the gas turbine engine 100, high cycle fatigue and blade failures are more likely to occur. The operating speed range is the range of speeds the gas turbine engine 100 is designed to operate at for long periods of time. Therefore it would beneficial to keep these natural frequencies and modal responses from occurring within the operating speed range of the gas turbine engine 100. The operating speed range can be 80% to 100% of the maximum RPM capacity of the gas turbine engine 100.

In an embodiment, the shape of the turbine blade 440*b* is formed so that the frequency of the first torsional modal response is changed without significantly changing the other natural frequencies of the turbine blade 440*b*, such as the first flexural response and the first bending response. The upper tuning edge 582 and middle tuning edge 584 partially define the location and the shape of the tuning region edge 580 portion of the trailing edge 447*b*. The size, shape, and position of the upper tuning edge 582 and middle tuning edge 584 can change the first torsional modal response of the turbine blade 440*b* so that the first torsional modal response occurs outside of the operating speed range of the gas turbine engine 100, while not moving the other natural frequencies and modal responses, such as bending and flexural modes, into the operating speed range of the gas turbine engine 100. In an embodiment the first torsional, first flexural, and first bending modes are considered, and subsequent modes such as a second torsional mode and third flexural modes are ignored due to their lack of oscillation strength and significance on the combustor system.

By including both the upper tuning edge 582 and the middle tuning edge 584, a developer or designer has two regions to adjust to tune the turbine blade 440*b* for the modal response of interest; in the example described herein, the first torsional modal response. Tuning to move a single modal response without moving other significant oscillation modal responses can be difficult, and having multiple edges portions to adjust, such as the upper tuning edge 582 and the middle tuning edge 584, provides for more control than a single edge portion to be adjusted.

The trailing edge 447*b* may include a first mode moving means for moving a first modal response of the turbine blade 440*b* outside of the operating speed range, and be disposed between the inner edge 547 and the outer edge 647. The trailing edge 447*b* may further include a second mode moving means for cooperating with the first mode moving means for moving the first modal response of the turbine blade 440*b* outside of the operating speed range and for keeping at least a second modal response outside of the operating speed range. The second mode moving mean can be disposed between the inner edge 547 and outer edge 647.

The first modal response can be a first torsional modal response, a flexural modal response, or a bending modal response of the turbine blade 440*b*. The first mode moving means and the second mode moving means can keep at least a third modal response outside of the operating speed range. The first mode moving means and the second mode moving means can move the torsional modal response beyond an operating speed of 100% of maximum RPM capacity of the gas turbine engine 100.

The size, shape, and position of the other edges along the trailing edge 447*b* may affect the performance of the turbine blade 440*b* as well. The lower tuning edge 586 may be sized, shaped and positioned to transition the lower transition edge 585 to the bottom transition edge 587 to improve the structural integrity and operating efficiency of the turbine blade 440*b*. Without the lower tuning edge 586 and the bottom transition edge 587, the lower transition edge 585 would create a sharper edge along the trailing edge 447*b* and could lead to a turbine blade that performs less, in regards to specific operation characteristics, than a turbine blade that includes the lower tuning edge 586 and the bottom transition edge 587. Similarly, the transition edges including the upper transition edge 581, the middle transition edge 583, the lower transition edge 585, and the bottom transition edge 587, can be shaped and sized to transition between the varying curvatures of the outer edge 647, upper tuning edge 582, middle tuning edge 584, lower tuning edge 586, and inner edge 547, to reduce sharp edges and improve the performance of the turbine blade 440*b*.

Although this invention has been shown and described with respect to detailed embodiments thereof, it will be understood by those skilled in the art that various changes in form and detail thereof may be made without departing from the spirit and scope of the claimed invention. Accordingly, the preceding detailed description is merely exemplary in nature and is not intended to limit the invention or the application and uses of the invention. In particular, the described embodiments are not limited to use in conjunction with a particular type of gas turbine engine. For example, the described embodiments may be applied to stationary or motive gas turbine engines, or any variant thereof. Furthermore, there is no intention to be bound by any theory presented in any preceding section. It is also understood that the illustrations may include exaggerated dimensions and graphical representation to better illustrate the referenced items shown, and are not consider limiting unless expressly stated as such.

It will be understood that the benefits and advantages described above may relate to one embodiment or may relate to several embodiments. The embodiments are not limited to those that solve any or all of the stated problems or those that have any or all of the stated benefits and advantages.

What is claimed is:

1. A turbine blade for use in a gas turbine engine having an operating speed range, the turbine blade comprising:
- a base
- an airfoil comprising
  - a skin extending from the base and defining a leading edge and a trailing edge opposite the leading edge, the trailing edge having
    - an inner edge disposed proximate to the base,
    - an outer edge disposed distal the inner edge, and
    - a tuning region edge disposed between the inner edge and the outer edge, and having
      - an upper transition edge extending from the outer edge towards the inner edge,
    - a middle transition edge disposed between the upper transition edge and the inner edge,
    - a lower transition edge disposed between the middle transition edge and the inner edge,
    - an upper tuning edge means for moving a first modal response of the turbine blade outside of the operating speed range, and disposed between the upper transition edge and the middle transition edge, being at least partially closer to the leading edge than the middle transition edge, and
    - a middle tuning edge means for cooperating with the upper tuning edge means for moving the first modal response of the turbine blade outside of the operating speed range and for keeping at least a second modal response outside of the operating speed range, and disposed between the middle transition edge and the lower transition edge, being at least partially closer to the leading edge than the middle transition edge.

2. The turbine blade of claim 1, wherein the tuning region edge includes a bottom transition edge disposed between the inner edge and the lower transition edge, and a lower tuning edge disposed between the lower transition edge and the bottom transition edge, the lower tuning edge being at least partially closer to the leading edge than the bottom transition edge.

3. The turbine blade of claim 1, wherein the upper tuning edge being at least partially closer to the leading edge than the upper transition edge and lower transition edge.

4. The turbine blade of claim 1, wherein the middle tuning edge being at least partially closer to the leading edge than the upper transition edge and lower transition edge.

5. The turbine blade of claim 1, wherein the upper tuning edge has a first radius and the middle tuning edge has a second radius, the ratio between the first radius and the second radius is between 0.50 to 1.50.

6. The turbine blade of claim 5, wherein the turbine blade has a stacking axis that passes through the airfoil and the base centroids and radially extends from a center axis, the upper tuning edge has a first center point and the middle tuning edge has a second center point, the first center point is spaced from the stacking axis at a first distance and the second center point is spaced from the stacking axis at a second distance, the ratio between the second distance and the first distance is between 0.80 to 1.60.

7. The turbine blade of claim 6, wherein the base includes a root end opposite the skin, the first center point is spaced from the root end at a first length, the second center point is spaced from the root end at a second length, the ratio between the second length and the first length is between 0.55 to 0.88.

8. A turbine blade for use in a gas turbine engine having an operating speed range, the turbine blade comprising:
- a base
- an airfoil comprising
  - a skin extending from the base and defining a trailing edge and a leading edge opposite the trailing edge, the airfoil having a tip end opposite the base, and the trailing edge having
    - an outer edge extending from the tip end towards the base,
    - an inner edge extending from the base towards the tip end,
    - a tuning region reference line extending from a radially most outward point of the inner edge to a radially most inward point of the outer edge, a tuning region edge disposed between the inner edge and the outer edge, and having an upper transition edge extending from the outer edge towards the inner edge, a middle transition edge disposed between the upper transition edge and the inner edge, a lower transition edge disposed between the middle transition edge and the inner edge, an upper tuning edge for moving a first modal response of the turbine blade outside of the operating speed range, and extending between the upper transition edge and the middle transition edge, and having at least a portion that is further from the tuning region reference line towards the leading edge than the middle transition edge, and a middle tuning edge for cooperating with the upper tuning edge for moving the first modal response of the turbine blade outside of the operating speed range and for keeping at least a second modal response outside of the operating speed range, and extending between the lower transition edge and the middle transition edge, and having at least a portion that is further from the tuning region reference line in the direction of the leading edge than the middle transition edge.

9. The turbine blade of claim 8, wherein the tuning region edge includes a bottom transition edge disposed between the inner edge and the lower transition edge, and a lower tuning edge extending between the lower transition edge and the bottom transition edge, the lower tuning edge being at least partially further from the tuning region reference line than the bottom transition edge.

10. The turbine blade of claim 8, wherein the upper tuning edge being at least partially further from the tuning region reference line than the upper transition edge and lower transition edge.

11. The turbine blade of claim 8, wherein the middle tuning edge being at least partially further from the tuning region reference line than the upper transition edge and lower transition edge.

12. The turbine blade of claim 8, wherein the upper tuning edge has a first radius and the middle tuning edge has a second radius, the ratio between the first radius and the second radius is between 0.50 to 1.50.

13. The turbine blade of claim 12, wherein the turbine blade has a stacking axis that passes through the airfoil and the base centroids and radially extends from a center axis, the upper tuning edge has a first center point and the middle tuning edge has a second center point, the first center point is spaced from a stacking axis at a first distance and the second center point is spaced from the stacking axis at a second distance, the ratio between the second distance and the first distance is between 0.80 to 1.60.

14. The turbine blade of claim 13, wherein the tuning region reference line has a convex curvature.

15. The turbine blade of claim 14, wherein tuning region reference line is linear.

16. A turbine blade for use in a gas turbine engine having an operating speed range, the turbine blade comprising:

a base; and an airfoil comprising a skin extending from the base and defining a leading edge and a trailing edge opposite the leading edge, the trailing edge having an inner edge disposed proximate to the base, an outer edge disposed distal the inner edge, a first mode moving means for moving a first modal response of the turbine blade outside of the operating speed range, and disposed between the inner edge and the outer edge, and a second mode moving means for cooperating with the first mode moving means for moving the first modal response of the turbine blade outside of the operating speed range and for keeping at least a second modal response outside of the operating speed range, and disposed between the inner edge and outer edge.

17. The turbine blade of claim 16, wherein the first modal response is a first torsional modal response of the turbine blade.

18. The turbine blade of claim 17, wherein the operating speed range is from 80% to 100% of maximum RPM capacity of the gas turbine engine.

19. The turbine blade of claim 18, wherein the first mode moving means and the second mode moving means keep at least a third modal response outside of the operating speed range.

20. The turbine blade of claim 17, wherein the first mode moving means and the second mode moving means moves the first modal response beyond an operating speed of 100% of maximum RPM capacity of the gas turbine engine.

* * * * *